US005079817A

United States Patent [19]

Anstötz et al.

[11] Patent Number: 5,079,817

[45] Date of Patent: Jan. 14, 1992

[54] APPARATUS FOR CONTROLLING THE HEATING AND COOLING OF A ROLL

[75] Inventors: Helmut Anstötz, Tönisvorst; Bernhard Brendel, Grefrath; Bernhard Funger, Krefeld, all of Fed. Rep. of Germany

[73] Assignee: Eduard Küsters Maschinenfabrik GmbH & Co KG, Krefeld, Fed. Rep. of Germany

[21] Appl. No.: 376,620

[22] Filed: Jul. 7, 1989

[51] Int. Cl.[5] ..... B21B 13/02; F28D 11/02; H05B 6/14

[52] U.S. Cl. ..... 29/116.1; 29/113.1; 29/113.2; 29/116.2; 100/93 RP; 165/89; 236/78 B; 219/10.492; 219/10.61 A

[58] Field of Search ..... 29/113.1, 113.2, 116.1, 29/116.2, 110; 165/30, 89; 100/93 RP, 162 B, 170; 236/78 B; 219/10.492, 10.61 A, 10.61 R, 10.77; 241/66, 67

[56] References Cited

U.S. PATENT DOCUMENTS

| | | | |
|---|---|---|---|
| 2,761,941 | 9/1956 | Ardichvili | 219/10.61 A |
| 4,425,489 | 1/1984 | Pav et al. | 219/10.492 |
| 4,498,383 | 2/1985 | Pav et al. | 100/162 B |

FOREIGN PATENT DOCUMENTS

| | | | |
|---|---|---|---|
| 211003 | 10/1957 | Australia | 100/93 RP |
| 1303467 | 3/1963 | Fed. Rep. of Germany | 165/30 |
| 2256457 | 11/1972 | Fed. Rep. of Germany | 236/72 B |

*Primary Examiner*—Joseph M. Gorski
*Assistant Examiner*—S. Thomas Hughes
*Attorney, Agent, or Firm*—Kenyon & Kenyon

[57] ABSTRACT

A hydraulically supported roll includes a stationary crosshead extending through a rotatable hollow roll, which is heated at its inner and outer circumferences. A thermostatic control and regulating device is provided to keep the temperatures at the inner circumference and the outer circumference of the hollow roll at the same level during the heatin-up and/or cooling-down phase.

5 Claims, 1 Drawing Sheet

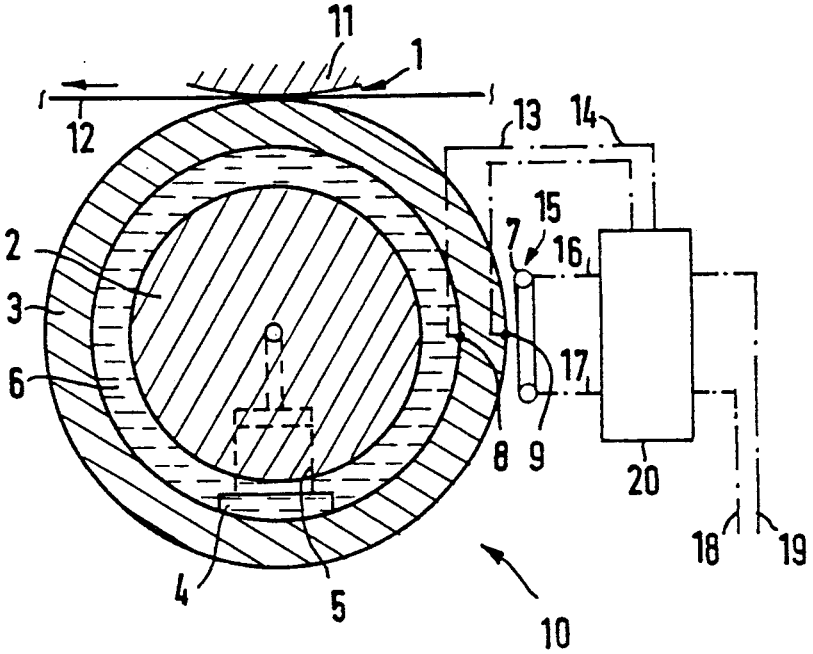
11
1
12
13
14
15
7
16
2
3
6
17
8
9
20
18
19
4
5
10

APPARATUS FOR CONTROLLING THE HEATING AND COOLING OF A ROLL

BACKGROUND OF THE INVENTION

The invention relates generally to rolls for treating webs of material and, more particularly, to apparatus for controlling the temperature of a heated roll as it is heated-up to, or cooled-down from, its operating temperature.

For some time, heatable rolls have been provided with internal canals through which a fluid heat carrier medium is conducted. The inner surfaces of these canals transfer heat from the fluid medium to the roll from the inside. In many cases, these canals are formed by deep holes extending parallel to the longitudinal axis of the rolls. The holes may have cross connections at their ends to provide a meandering flow path for the fluid medium, which ensures a uniform temperature distribution. Peripherally-drilled rolls, which are employed in paper-making machines and calendars, can now be made with working widths up to 7,500 mm. More frequently, however, for large working roll widths, hydraulically supported rolls are employed in which a hollow roll is rotatable about a stationary crosshead. In this type of roll, the inside roll surface to which heat is transferred is the inner circumference of the hollow roll, and therefore, manufacturing problems that would arise in creating the inside roll surface, comparable to those in rolls having deep-drilled holes, are obviated. The heat is transmitted through the heat carrier medium, which is located in the interior clearance space between the hollow roll and crosshead. This medium is in contact with the inner circumference of the hollow roll to transfer heat to the roll. These hydraulically supported rolls can be manufactured with the largest dimensions that can be employed in practice, i.e., up to about 10 m in length and 1 m in diameter.

Such large roll bodies are formed by casting. In the casting process, a structure develops that has certain restrictions with respect to further temperature stress. While the problem of the thermal stress fundamentally exists in all heated rolls, it is particularly pronounced in cast hollow rolls of the gray iron or chilled cast type. These materials are brittle and their structure has a tendency to fracture if subjected to tensile stress; the fracture points can be starting points for larger cracks. Especially dangerous in this regard are chilled cast tubes or cylinders because of the pattern of internal stress formed in their manufacture. The producers of such rolls prescribe a maximum heating-up rate of about 2° C./min when heating from one side. Otherwise, a stress may result that exceeds the strength of the structure due to the thermal stress generated by a larger temperature differential being superimposed on the internal stress.

Heating-p rates on the order of magnitude mentioned above require waiting two to three hours until the rolls are heated to an operating surface temperatures of 200° to 300° C. before production can start. Since rolls of the type under discussion are usually parts of larger systems, corresponding shutdown periods of the larger systems, with the attendant loss in economic efficiency, ensue.

In addition to the heating-up process, the abovementioned problems also occur when rolls are being cooled-down. Fast cool-down may be necessary so that the roll can continue to operate at low temperature in the event of a product change or, upon a change of rolls, so that the temperature can be lowered to a value that permits disassembly of the roll.

SUMMARY OF THE INVENTION

Accordingly, one of the problems to which the invention is concerned is the problem of shortening the heating-up and cooling-down time periods of rolls of the type under discussion, without endangering the structural integrity of the hollow rolls.

According to the invention, the problem is solved by provision of a temperature controllable roll for treating webs of material that includes an inner surface disposed within the roll and an outer working surface disposed at an outer circumference of the roll. An inner temperature adjusting device is disposed inside the roll for adjusting the temperature of the inner surface and an outer temperature adjusting device is disposed outside the roll for adjusting the temperature of the outer working surface. A thermostatic control and regulating device is coupled to at least one of the inner temperature adjusting device and the outer temperature adjusting device for maintaining the temperature of the inner surface and the temperature of the outer working surface at the same level during a first temperature adjustment phase in which the inner and outer temperature adjusting devices change the temperatures of the inner surface and outer surface, respectively, from a first predetermined value to a second predetermined value.

Since the temperature is the same at the outer and inner surfaces of the hollow roll, the generation of high temperature gradients in a direction radial to the hollow roll is prevented. While there can be a temperature gradient between the inner and outer circumferential surfaces of the hollow roll and its interior, such a temperature gradient is limited because of the relatively small heat capacity, along with the great thermal conductivity, of the hollow roll. No temperature differential between the inside and outside of the hollow roll occurs that results in thermal stress which, together with the internal stress, can have harmful consequences. No heat is exchanged though the roll body because a temperature differential between the inside and outside of the roll is not present.

While the invention can be achieved in older heatable rolls having internal canals, the preferred field of application of the invention is hydrostatically supported rolls, i.e., rolls in which a stationary crosshead extends through a hollow roll to form a surrounding clearance space therebetween in which a hydraulic supporting device, typically a hydraulic fluid or piston-like supporting elements, is disposed. The advantages of the invention are particularly apparent in these rolls because the dimensions of the hollow roll and the thermal stress therein are particularly large when temperature changes are left to arbitrarily adjust themselves.

A hydraulically supported roll in which heating from the inside is carried out by a fluid pressure medium and inductive heating occurs from the outside of the roll is disclosed, per se, in DE-OS 3429695. However, this document fails to concern itself with the heating-up and cooling-down problems discussed above.

In conjunction with the thermostatic control device of the invention, the outer heating device may be an inductive heating device as such devices are easy to regulate and have fast response times.

The apparatus of the invention enables the rate of temperature change to be increased to about 5° C./min, which corresponds to a shortening of the required heating-up and cooling-down time periods by one to two hours.

Further features, advantages and embodiments of the invention are apparent from consideration of the following detailed description, drawing and appended claims.

BRIEF DESCRIPTION OF THE DRAWINGS

The sole drawing FIGURE schematically illustrates a transverse cross sectional view taken through a roll constructed according to the principles of the invention

DETAILED DESCRIPTION

The sole FIGURE illustrates in transverse section a roll 10, which along with a counterroll 11 forms a roll gap or nip 1 through which, for instance, a web 12 of paper or of a fleece to be solidified is conducted. The roll 10 comprises a stationary crosshead 2 about which a hollow cylinder or roll 3 rotates. The crosshead 2 extends through the hollow cylinder 3 to form an annular clearance space 6 between the inner circumference of hollow roll 3 and the outer surface of crosshead 2. The hollow roll 3 is supported on the crosshead 2 by support elements 4, which are arranged in cylindrical bores 5 of the crosshead 2 for radial movement toward the inner circumference of the hollow roll 3. Several support elements 4 are provided along the length of the roll and the elements can be controlled individually or in groups. In the illustrated embodiment, the space 6 between the crosshead 2 and the hollow roll 3 is completely filled with pressurized hydraulic liquid and the support elements 4 are designed as seals preventing the pressurized liquid from acting in zones or regions defined by the cross section of the support elements. Therefore, in these zones, no pressure is exerted against the inner circumference of the hollow roll 3 on this side of the crosshead and the net result is an upwardly directed force, which pushes against cylinder 3 with a force that corresponds to the pressure in imaginary areas on the top side of the crosshead 2 diametrically opposed from the unpressurized sealed zones. The pressurized liquid filling the space 6 may be heated.

The temperatures at the inner and outer circumferences of the hollow roll 3 are determined by sensors 8 and 9, respectively, which then feed a signal indicative of the sensed temperatures via lines 13, 14 to a thermostatic control device 20 for regulating the temperature of the roll. The thermostatic control and regulating device 20 is coupled via lines 16, 17 to operate an inductive heating device 15 having a conductor loop 7, which is spaced closely from the outer circumference of the hollow roll 3 to heat the outer circumference of the hollow roll 3. The thermostatic control and regulating device 20 also may be coupled via the lines 18, 19 to control a heat exchanger (not shown) used to regulate the temperature of the pressurized liquid in the space 16.

The thermostatic control and regulating device 20 ensures that the same temperature always prevails at the inner and outer circumferences of the roll 3 during the heating-up phase in which the hollow roll 3 is brought from room temperature up to an elevated temperature of approximately 200° C. to 300° C., i.e., the temperature is the same at both the inner circumference 8 of the hollow roll 3, and at the outer circumference 9 of the hollow roll 3. Device 20 operates similarly during the cooling-down phase in which the hollow roll 3 is brought from its operating temperature (200° C.-300° C.) down to room temperature to ensure that the same temperature exists at the inner and outer circumferences of the hollow roll throughout the cooling-down phase.

The roll 10 may have a different construction than the specified design shown. The invention may be employed in different types of rolls, for instance, in rolls in which the support plungers are arranged on the same side as the roll gap 1 and locally exert positive pressures against the inner circumference of the hollow roll 3. The invention is equally applicable to rolls in which longitudinal seals extend along the crosshead 2 at its widest points to form a longitudinal pressure chamber having a semi-cylindrical shell shape at the side of the roll gap 1. The pressure chamber can be filled with hydraulic liquid to exert a uniform pressure over the length of the longitudinal chamber against the inner circumference of the hollow roll 3.

The invention does not require that the heating of the inner circumference of the hollow roll 3 be accomplished by the pressurized hydraulic liquid used to support the roll. Furthermore, a different type of outer heating device may be provided instead of the inductive conductor loop shown.

The illustrated embodiment is preferred in that it represents a heated roll. However, the invention is likewise applicable to a cooled roll which is exposed, for instance, at its outer and the inner surfaces to the action of a cooling substance, such as liquid nitrogen.

What is claimed is:

1. A temperature-controllable roll for treating webs of material comprising:

a rotatable hollow cylinder having an inner circumference and an outer circumference;

a stationary crosshead extending lengthwise through the hollow cylinder;

a surrounding clearance space formed between the inner circumference of the hollow cylinder and the crosshead;

a support device for supporting the hollow cylinder on the crosshead;

an outer working surface disposed at the outer circumference of the roll;

an inner temperature adjusting device disposed inside the roll for adjusting the temperature of the inner circumference;

an outer temperature adjusting device disposed outside the roll for adjusting the temperature of the outer working surface;

a thermostatic control and regulating device coupled to at least one of said inner temperature adjusting device and said outer temperature adjusting device, said thermostatic control and regulating device including an inner sensor disposed at the inner circumference of the hollow cylinder for sensing the temperature at the inner circumference and an outer sensor disposed at the outer circumference of the hollow cylinder for sensing the temperature at the outer working surface wherein said thermostatic control and regulating device maintains the temperature of the inner circumference and the temperature of said outer working surface at the same level during a first temperature adjustment phase in which said inner and outer temperature adjusting devices change the temperatures of the inner circumference and outer surface, respectively, from a first predetermined value to a second predetermined value.

2. The roll of claim 1 wherein said first predetermined value is approximately room temperature and the second predetermined value is between 200° C. and 300° C.

3. The roll of claim 1 wherein said outer heating device comprises an inductive heating device.

4. The roll of claim 1 wherein said support device comprises a hydraulic support device including a hydraulic liquid for supporting the hollow cylinder and transferring heat to the inner circumference of the hollow cylinder.

5. The roll of claim 1 wherein said support device comprises a hydraulic support device including a hydraulic liquid for supporting the hollow cylinder and transferring heat to the inner circumference of the hollow cylinder, said first predetermined value is approximately room temperature and the second predetermined value is between 200° C. and 300° C. and said outer heating device comprises an inductive heating device.

* * * * *